US005129143A

United States Patent [19]

Wei et al.

[11] Patent Number: 5,129,143

[45] Date of Patent: Jul. 14, 1992

[54] DURABLE PLATING FOR ELECTRICAL CONTACT TERMINALS

[75] Inventors: I-Yuan Wei, Hershey; John R. Miller, Harrisburg, both of Pa.

[73] Assignee: AMP Incorporated, Harrisburg, Pa.

[21] Appl. No.: 581,261

[22] Filed: Sep. 10, 1990

Related U.S. Application Data

[63] Continuation of Ser. No. 449,159, Dec. 15, 1989, abandoned, which is a continuation of Ser. No. 828,084, Feb. 7, 1986, abandoned, which is a continuation of Ser. No. 444,940, Nov. 29, 1982, abandoned.

[51] Int. Cl.[5] ..... H01R 13/03

[52] U.S. Cl. ..... 29/885; 439/886

[58] Field of Search ..... 439/886, 887; 29/885

[56] References Cited

U.S. PATENT DOCUMENTS

| | | | |
|---|---|---|---|
| 1,904,241 | 4/1933 | Kammerer | 338/278 C |
| 2,846,649 | 8/1958 | Hornauer | 324/155 |
| 2,897,584 | 8/1959 | Schumpelt | 339/278 C |
| 4,138,604 | 2/1979 | Harmsen et al. | 339/278 C |

FOREIGN PATENT DOCUMENTS 0140619 10/1984 European Pat. Off. .

OTHER PUBLICATIONS

Characteristics of Palladium Gold Sliding Contact for Connectors I. Andoh et al, IEEE, CHI781,-Apr. 1982.

Friction Properties of Palladium-Gold Multilayer Contacts Takehiko Sato et al, Fujitsu Sci. Tech. J., 18, Mar. 1, 1982, pp. 83-100.

Palladium With A Thin Gold Layer As A Sliding Contact Material Sato et al, IEEE Transactions vol. CHMT-4 No. 1, Mar. 1981, pp. 10-14.

*Primary Examiner*—Gary F. Paumen

*Attorney, Agent, or Firm*—Katherine A. Nelson

[57] ABSTRACT

Electrical contact terminals having two layer plated coating thereon is disclosed. The coating consists of a layer of palladium having a macrostress in the range of 30,000 to 140,000 psi and a layer of gold, the gold being at lest 99.9% pure and having a Knoop hardness from 60 to 90. A coating comprised of medium stress palladium and gold substantially and unexpectedly inmproves the durability of terminals as compared to similar coatings using gold and low or high stress palladium.

5 Claims, 2 Drawing Sheets

DURABLE PLATING FOR ELECTRICAL CONTACT TERMINALS

This application is a continuation of application Ser. No. 07/449,159 filed Dec. 15, 1989, now abandoned, in turn, a continuation of application Ser. No. 06/828,084 filed Feb. 7, 1986, now abandoned, in turn a continuation of application Ser. No. 06/440,940 filed Nov. 29, 1982 now abandoned.

FIELD OF THE INVENTION

This invention relates to electrical contact terminals having layers of noble metal electrodeposited thereon.

BACKGROUND OF THE INVENTION

Electrical contact terminals used in the electronic industry must be good electrical conductors, highly reliable under repeated use, and at the same time be resistant to corrosion or oxidation. Traditionally, the industry has met these criteria by plating the terminals with hard gold. The accelerating price of gold, however, has encouraged the industry to find less expensive means while maintaining the desired characteristics.

The use of palladium instead of gold has been explored by the industry. Although palladium has been found to be a good conductor, corrosion resistant and less expensive than gold, palladium has been found to be unreliable for terminals that require repeated matings. Depending upon which of the many known palladium plating baths was used, repeated mating of the plated contact terminals either wore through the palladium layer or caused the palladium layer to crack and abrade the surface of the mating parts. Either type of problem causes the contact terminals to fail.

Until now, efforts to solve these long standing problems have been unsuccessful. The disclosed invention solves the above problems by the discovery that the internal macrostress within the palladium layer itself is the cause of the problems. The internal macrostress of the palladium is measured by X-ray defraction according to the procedure described by C. N. J. Wagner et al, Trans. Mat. Soc. AIME 233, 1280(1965). When the plated palladium has a low internal macrostress, less than 30,000 psi (low stress palladium), the palladium layer wears out through adhesive wear after a few matings. Palladium having high internal macrostress, greater than 140,000 psi, fractures when subjected to repeated matings, causing abrasive wear. Plating baths which deposit palladium having a macrostress in the range of 30,000 to 140,000 psi (medium stress palladium) produce contact terminals which exhibit much greater wear characteristics than contacts plated with low or high stress palladium. A small number of the medium stress palladium contact terminals, however, show early wear and spontaneously exhibit macrocracks. This problem with the medium stress palladium is prevented and the wear characteristics of these palladium plated contact terminals are unexpectedly and surprisingly increased by the application of a layer of pure soft gold. The gold used must meet MIL SPEC. MIL-G-45204B Type III Grade A, Gold percentage 99.9, Knoop maximum 90.

PREFERRED EMBODIMENT OF THE INVENTION

Figure 1:
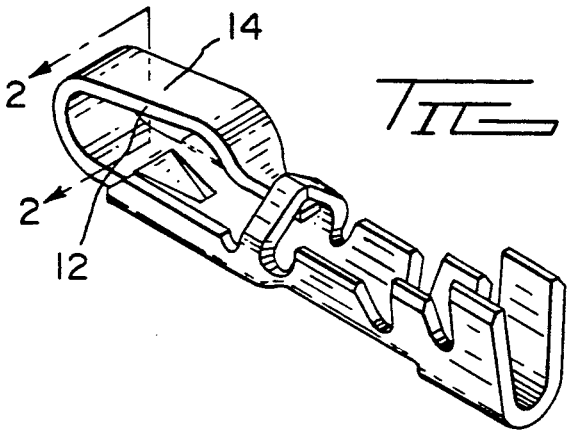
FIG. 1 is a three dimensional view of an electrical contact terminal which has been plated according to the invention.
Figure 2:
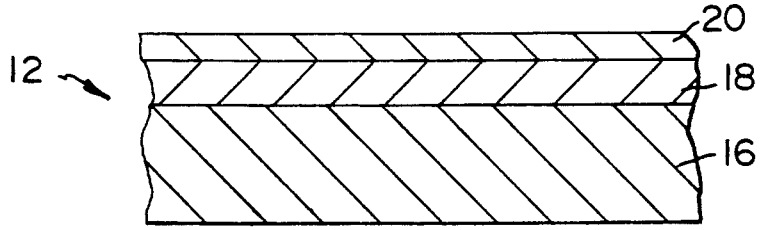
FIG. 2 is a cross-sectional view of the plated area of the terminal taken along the lines 2—2 of FIG. 1.
Figure 3:
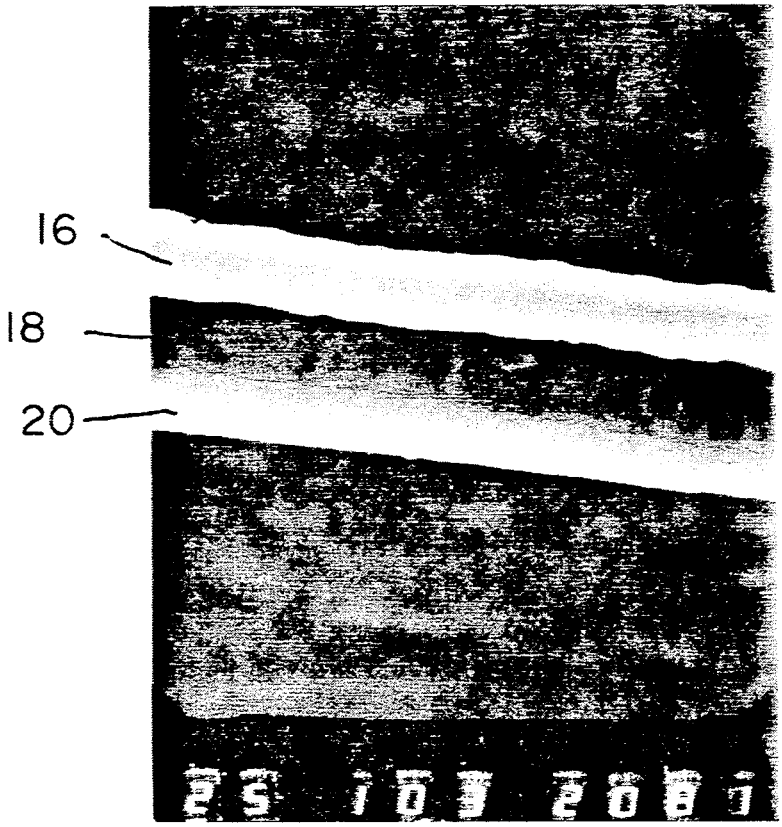
FIG. 3 is a micrograph of a cross-section of the plated contact zone of the terminal of FIG. 1 showing the layers of plating on the terminal, the magnification being 10,000 times. An AMR scanning electron microscope with Kavex Line X-Ray Fluorescence Detector was used.

Referring to FIG. 1, an electrical contact terminal 10, having a contact zone 12 with a plated surface 14. Referring now to FIGS. 2 and 3, a cross-sectional view of the contact zone 12 shows the substratum 16 of terminal 10, the layer of plated palladium 18 and the layer of gold 20 on the palladium layer 18. FIG. 3, also being a micrograph of a cross-section of the contact zone 12 of a terminal 10 plated according to the invention, shows the relative thickness of the layers of plating on the substratum 16. The gold layer 20 is obviously much thinner than the palladium layer 18.

Figure 4:
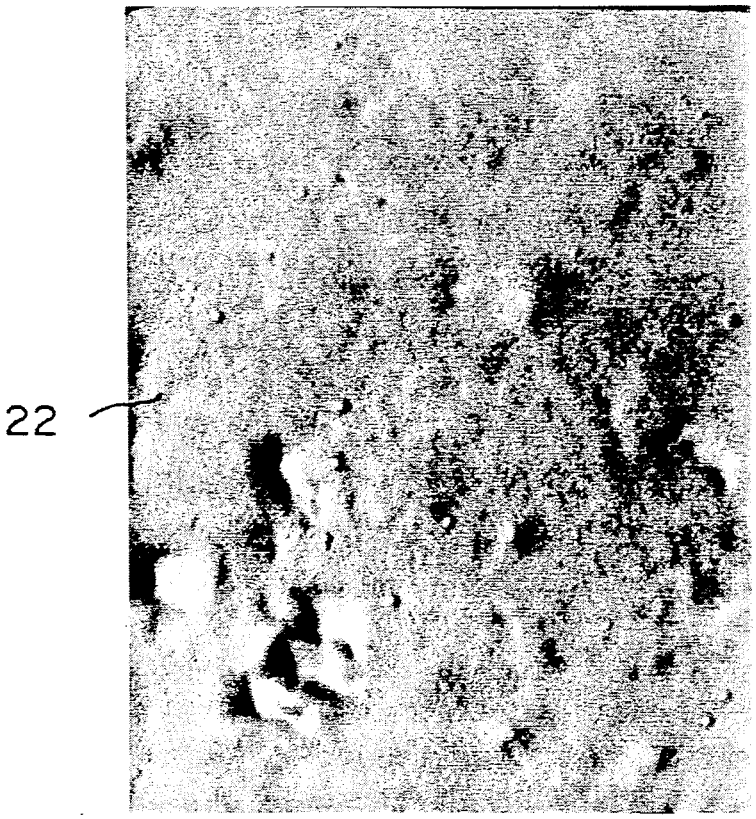
FIG. 4 is a surface view of the plated contact zone of the terminal of FIG. 1, the magnification being 1000 times.

FIG. 4 is a surface view of a plated contact terminal 10, at a magnification of 1000. The picture shows that the plated contact area is free from microcracks.

The entire surface of terminals may be plated according to the disclosed invention. It is more economical, however, to selectively plate only the contact zone of the terminals with palladium and gold. If selective plating is desired, the terminal receives an underplating of nickel in order to protect all the areas of the terminal that are not later protected by palladium and gold.

In the preferred embodiment, the substratum of the contact terminal is initially plated with a strike of noble metal, gold, silver or palladium, preferably palladium, in order to promote adhesion of the subsequent palladium and gold layers. A palladium strike, unlike a gold or silver strike is indistinguishable from the subsequent palladium layer when viewed with an electron microscope, as in FIG. 3. The use of noble metal strikes for adhesion is well known by those skilled in the art. Numerous plating baths, as known in the art, can be used for producing these strikes.

A 5 to 100 microinch, preferably a 15 to 80 microinch, thick layer of palladium having a macrostress in the range of 30,000 to 140,000 psi, preferably 60,000 to 100,000 psi, is plated on the terminal. One bath for plating palladium within the desired macrostress range is disclosed in U.S. Pat. No. 1,970,950.

The bath contains an aqueous solution of $Pd(NO_2)_4^{-2}$, in an amount sufficient to provide a palladium concentration from about 0.61 to 3.7 troy ounces per gallon. The bath is operated at a temperature ranging from 113° to 167° F., a pH ranging from 4.5 to 7.5, and a current density of 10 amperes per square foot.

A layer of soft pure gold ranging in thickness from 1 to 7 microinches, preferably 2 to 4 microinches, is plated over the palladium layer. The gold must be at least 99.9% pure and must have a Knoop hardness in the range of 60 to 90. The gold being soft, acts as a contact lubricant as the terminals are subjected to repeated matings. Any gold plating bath that meets MIL SPEC MIL-G45204B Type III, Grade A, Gold percentage 99.9, Knoop maximum 90, can be used to plate the gold layer.

The success of this particular two layer plating system is extraordinary. While the use of gold over palladium for plating has been discussed in U.S. Pat. No. 4,138,604, the gold used therein was hard gold. Gold was used in the belief that it filled the pores of the underlying palladium, thus giving a smooth contact surface.

It has been determined by the inventors that the use of a thin layer of soft gold over palladium dramatically improves the durability of the contact finish. The soft gold acts as a solid lubricant thus reducing the coefficient of friction and thereby reducing the adhesive wear of the system. It also totally eliminated the erratic, early wearthrough found in some of the medium stress palladium deposits.

A hard gold flash over palladium has none of these attributes. This combination behaves in a similar manner to the bare palladium deposit by exhibiting adhesive wear and also early brittle fracture of the deposit.

A wear testing device consisting of a flat reciprocating lower surface and a stationary hemispherical upper surface or terminal was used to determine the durability of plated terminals. The device measures both frictional forces and contact resistance. See Rabinowitz, *Friction and Wear of Materials*, John Wiley and Sons, Inc., New York, 1965, p.104, for a similar device.

Terminals were mounted in the device. The durability of the contact surface was determined by applying a 0.44 pound load to the terminal to simulate typical contact force and subjecting the loaded terminal to the reciprocating motion of the device, each cycle of the device representing one insertion and one withdrawal of the terminal. The number of completed cycles was counted until base metal was exposed, the plated surface exhibited microcracks, or a predetermined number of cycles was achieved.

The following examples illustrate the extraordinary and unexpected results achieved by plating terminals with medium stress palladium and soft gold as disclosed herein, as compared with terminals plated with medium stress palladium and no gold or other high or low stress palladium and soft gold.

EXAMPLE 1

A number of terminals of the type illustrated in FIG. 1 were plated in the preferred manner. The phosphor bronze substrate of the terminal was first plated with 100 microinches of nickel using a nickel sulfamate (chloride free) bath. See George A. DiBari, 49th Guidebook, Metal Finishing, p. 278, 1981, Metals and Plastics Publications, Inc., Hackensack, N.J.

A strike of palladium to aid the adherence of the subsequent palladium layer was then applied. The commercial Decorex plating bath was used. This bath is available from Sel-Rex, Nutley, N.J. 07110. The bath was operated at 75° F., a pH of 9, and a current density of 10 amperes per square foot.

The terminals were then plated with 72 microinches of medium stress palladium using the bath as described in U.S. Pat. No. 1,970,950. The palladium concentration was 1.22 troy ounces per gallon. The bath was operated at a temperature of 140° F., a pH of 6.0, and a current density of 10 amperes per square foot.

The terminals were then plated with about 3.7 microinches of soft gold. The bath used for these samples contained an aqueous solution of $KAu(CN)_2$ in an amount sufficient to provide a gold concentration of 1 troy ounce per gallon. The bath was operated at 140° F., pH 6.2, and a current density of 5 amperes per square foot.

The residual macrostress of these terminals ranged from 80,000 to 130,000 psi. In the durability tests, all of the samples completed 1000 cycles without exhibiting failure. A few samples were subjected to further testing for durability and reached 10,000 cycles without failure. The contact resistance of terminals plated with medium stress palladium and soft gold was not affected by exposure to 480° F. for 16 hours.

EXAMPLE 2

A number of terminals of the type illustrated in FIG. 1 were plated with nickel, palladium strike, and palladium in the same manner as those in Example 1. No soft gold was plated on these samples.

The macrostress of the medium stress palladium on these samples ranged from 60,000 to 140,000 psi. Over ninety per cent of these terminals failed to complete 50 cycles in the durability test.

EXAMPLE 3

Terminals of the type illustrated in FIG. 1 were plated with nickel and a palladium strike as previously described in Example 1. The terminals were then plated with 75 microinches of palladium using the commercially available Pallaflex bath. This bath is available from Vanguard Research Associates, Inc., South Plainfield, N.J. 07080. The bath was operated at 149° F., a pH of 6.8, and a current density of 10 amperes per square foot. Three microinches of soft gold was plated over the palladium layer using the same gold bath as Example 1.

The residual macrostress in the sample tested was 13,000 psi. The contact surface of this terminal failed at less than 10 cycles in the durability test.

EXAMPLE 4

Terminals of the type illustrated in FIG. 1 were plated with nickel and a palladium strike as previously described in Example 1. The terminals were then plated with 75 microinches of palladium using the commercially available Pallaspeed bath. This bath is available from Technic, Inc., Cranston, R.I. 02910. The bath was operated at 149° F., a pH of 5.8, and a current density of 10 amperes per square foot. Three microinches of soft gold was plated over the palladium layer using the same gold bath as Example 1.

The residual macrostress of the samples tested was in the range of 140,000 to 160,000. Durability testing of samples in this range gave erratic results. Some of the samples failed after two cycles, some after ten cycles, and some survived 1000 cycles.

As is clearly illustrated by the foregoing examples, terminals plated according to the herein disclosed invention have a substantial and unexpected increase in durability.

It is to be understood that the type of terminal used for the examples is only representative of many types of terminals. The same relative increase in durability of the contact surface will be obtainable with other types of terminals.

What is claimed is:

1. A method for making plated electrical contact terminals for mating with complementary contact members, said terminals having increased durability, the method comprising the steps of:

selecting electrical contact terminals;

selecting a palladium plating solution and selecting process parameters for plating palladium from a bath of said solution onto electrical contact terminals;

plating a layer of palladium from said bath onto said terminal and;

plating a layer of gold on said palladium layer having Knoop hardness ranging from 60 to 90;

said selecting of said solution and said parameters being optimized so that the palladium layer of terminals plated thereby consistently has a level of internal macrostress of at least 30,000 p.s.i. and up to about 140,000 p.s.i.; whereby the presence of such a substantial macrostress characteristic of the plated palladium layer substantially increases the durability of the contact terminals for long in-service life.

2. The method of claim 1 wherein the macrostress of the palladium layer is preferably in the range of 40,000 to 130,000 p.s.i.

3. The method of claim 1 wherein the palladium layer has a thickness between 5 to 100 microinches, preferably 15 to 80 microinches.

4. The method of claim 1 wherein said gold is at least 99.9 percent pure.

5. The method of claim 1 wherein the gold layer is within the range of 1 to 7 microinches, preferably 2 to 4 microinches.

* * * * *